US005092107A

United States Patent [19]

Lamm

[11] Patent Number: 5,092,107

[45] Date of Patent: Mar. 3, 1992

[54] METHOD OF MAKING FLIP-TOP CARTONS

[75] Inventor: Klaus P. Lamm, Durbanville, Cape Province, South Africa

[73] Assignee: Tobacco Research & Development Institute Limited, South Africa

[21] Appl. No.: 720,630

[22] Filed: Jun. 25, 1991

Related U.S. Application Data

[62] Division of Ser. No. 570,634, Aug. 22, 1990, Pat. No. 5,044,550.

[30] Foreign Application Priority Data

Aug. 22, 1989 [ZA] South Africa ..... 89/6398

[51] Int. Cl.[5] ..... B65B 7/28; B65B 19/10; B31B 7/14; B31B 15/28

[52] U.S. Cl. ..... 53/449; 53/444; 53/485; 493/110; 493/167; 493/176; 493/911

[58] Field of Search ..... 53/444, 449, 485; 493/56, 67, 76, 104, 110, 167, 175, 176, 911

[56] References Cited

U.S. PATENT DOCUMENTS

| | | | |
|---|---|---|---|
| 1,284,583 | 11/1918 | Burgess | 493/175 |
| 2,387,392 | 10/1945 | Guyer et al. | 493/175 |
| 4,308,023 | 12/1981 | Bidegain | 493/295 |
| 4,708,704 | 11/1987 | Focke et al. | 493/151 |

*Primary Examiner*—William E. Terrell
*Attorney, Agent, or Firm*—Cushman, Darby & Cushman

[57] ABSTRACT

A carton (11) with parallel flat front and rear surfaces joined by curved sides and a flip-top lid (10) hinged to the carton. The carton is composed of two superimposed layers adhesively secured at a joint line at lapped edges. The outer layer is slit along its front surface parallel to the carton ends and along upwardly extending curves around the sides to a fold line parallel to and raised above the front slit and the inner layer (12) has a cutout in its front surface above the front slit of the outer layer. The cutout curves upwardly short of the sides where tags (13) are cut out of the sides of the inner layer and the outer layer overlaps the inner layer at the carton ends. Top and bottom closures are adhesively secured to the outer layer at the ends of the carton.

1 Claim, 5 Drawing Sheets

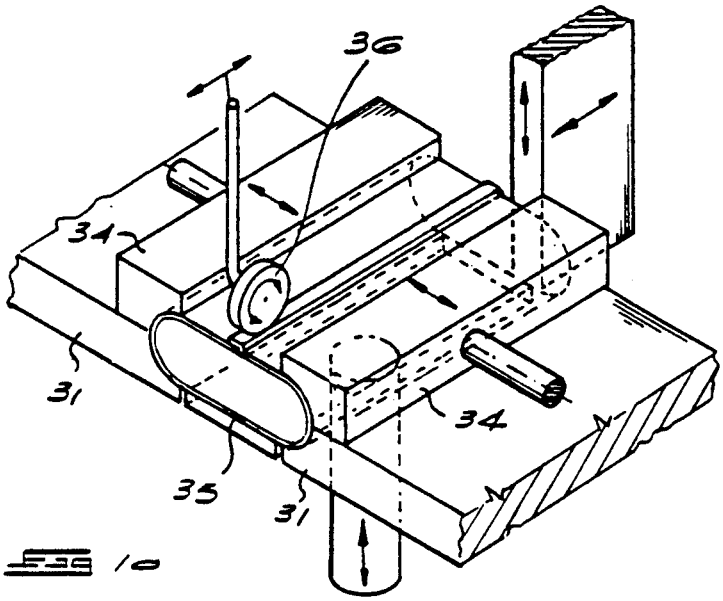
FIG 10
FIG 11
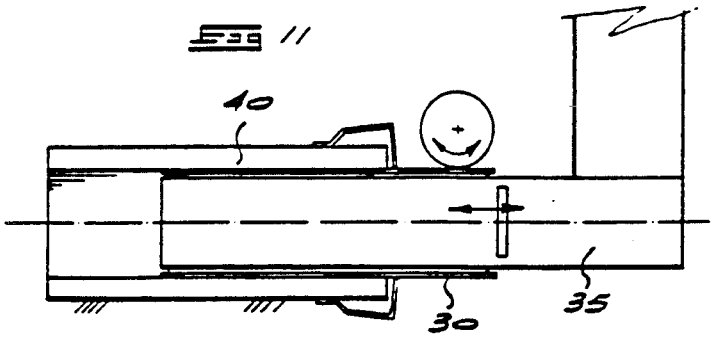
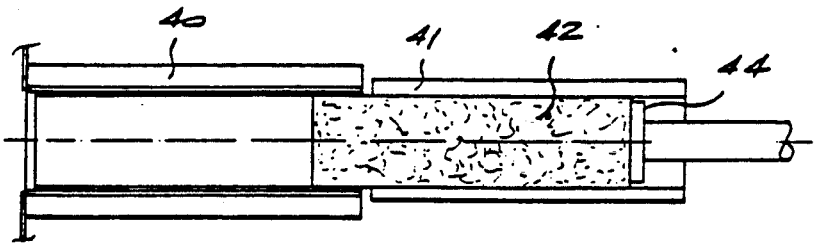
FIG 12

METHOD OF MAKING FLIP-TOP CARTONS

This is a division of application Ser. No. 07/570,634, filed Aug. 22, 1990, U.S. Pat. No. 5,044,550.

BACKGROUND TO THE INVENTION

This invention relates to flip-top cartons.

Flip-top cartons are known in a number of applications, e.g. for packaging cigarettes and are usually of rectangular parallelepiped shape.

Attractive packages have been provided by forming cartons with curved sides and detachable lids. It would be an advantage to have such cartons with tops that can flip.

In this regard the applicant is aware of European Patent No. 0,204,933—Focke and Co. GMbH which describes a flip top carton in which the longitudinal edges of the lid and the box part are angled so that the box has an octagonal cross section. In addition, European Patent No. 0,200,087—Focke and Co. GMbH-describes a process and apparatus for producing flip-top cartons with bevelled or rounded longitudinal edges. In this process, the rounded or bevelled edges are formed on the flat blank prior to folding of the box.

SUMMARY OF THE INVENTION

This invention provides a carton with parallel flat front and rear surfaces joined by curved sides and a flip-top lid hinged to the carton, composed of two superimposed layers adhesively secured at a joint line at lapped edges, in which the outer layer is slit along its front surface parallel to the carton ends and along upwardly extending curves around the sides to a fold line parallel to and raised above the front slit, the inner layer having a cutout in its front surface above the front slit of the outer layer, which cutout curves upwardly short of the sides where tags are cut out of the sides of the inner layer, the outer layer overlapping the inner layer at the carton ends and top and bottom closures being adhesively secured to the outer layer at the ends of the carton.

It is preferred that the outer and inner layers are secured at mating edges along the rear centre line of the carton.

The invention further provides that the carton be fashioned from blanks for the outer and inner layers which have been formed with parallel creases along areas defining the sides of the carton, a slit providing the front and curved slits in the outer layer and U-shaped slits in the inner layer for the tags, the outer layer being formed with creases for the hinge line.

The carton of the invention is suitable for packaging a wide variety of articles and is particularly adapted for the packaging of cigarettes.

According to an aspect of the invention in the packaging of cigarettes, the cigarettes assume a particular configuration in end view such that with a package for twenty cigarettes the distance between the front and back panels is three times the cigarette diameter, the centre of the package is occupied by six cigarettes spanning the distance while each side is occupied by seven cigarettes resembling a daisy with a central cigarette surrounded by six petal cigarettes. When packaging ten cigarettes in a packet the inside width of the packet will be slightly less than three times the diameter of a cigarette as the three rows of cigarettes will be staggered with respect to each other.

The invention includes a process of manufacturing a carton with parallel flat front and rear surfaces joined by curved sides and a flip-top lid hinged to the carton, the process including the steps of:

- cutting inner and outer layer blanks for the carton;
- slitting the outer layer blank, along an area defining the front surface of the carton, parallel to the carton ends and along upwardly extending curves, around areas defining the sides of the carton, to a fold line parallel to and raised above the front slit;
- forming a cutout in the inner layer blank, in an area defining the front surface of the carton, above the front slit of the outer layer, which cutout curves upwardly short of the side areas;
- cutting tags out of the sides of the inner layer blank;
- superimposing the two layers on one another and forming a laminate of the two layers with the outer layer overlapping the inner layer at the carton ends;
- shaping the laminate into a tubular shell with parallel flat front and rear surfaces joined by curved sides and adhesively securing the laminate edges at a joint line at overlapping the edges of the shell; and
- securing top and bottom closures adhesively to the outer layer at the ends of the carton.

DESCRIPTION OF THE DRAWINGS

FIG. 10 is a pictorial representation of the step shown in FIG. 9;

FIGS. 11 and 12 diagrammatically illustrate a carton filling process;

DESCRIPTION OF EMBODIMENTS

Figure 1:
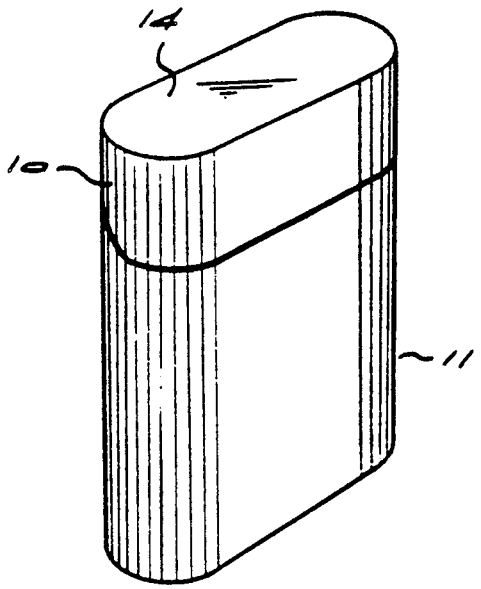
FIG. 1 is a pictorial view of a carton according to the invention in its closed position.
Figure 2:
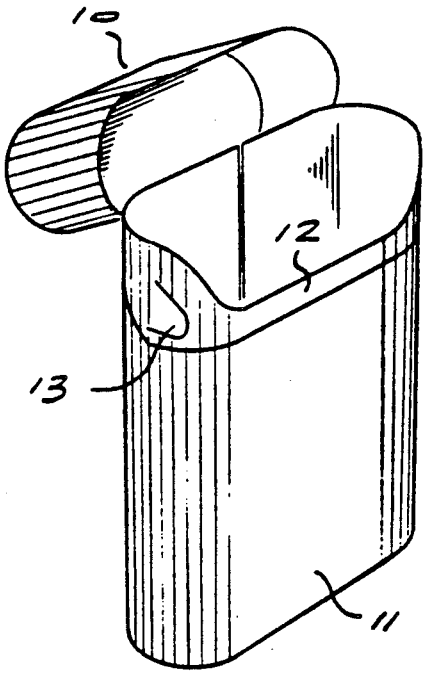
FIG. 2 is a pictorial view showing the lid flipped open.

In FIGS. 1 and 2 a carton according to the invention is illustrated.

The carton has a single shell lid 10 hinged to a body 11 which comprises an outer shell fitting over an inner shell 12 formed with cutouts providing locking tags 13 for the lid 10. The carton is intended to contain cigarettes, but in principle the carton could contain any other articles or objects such as a perfume bottle.

Figure 3:
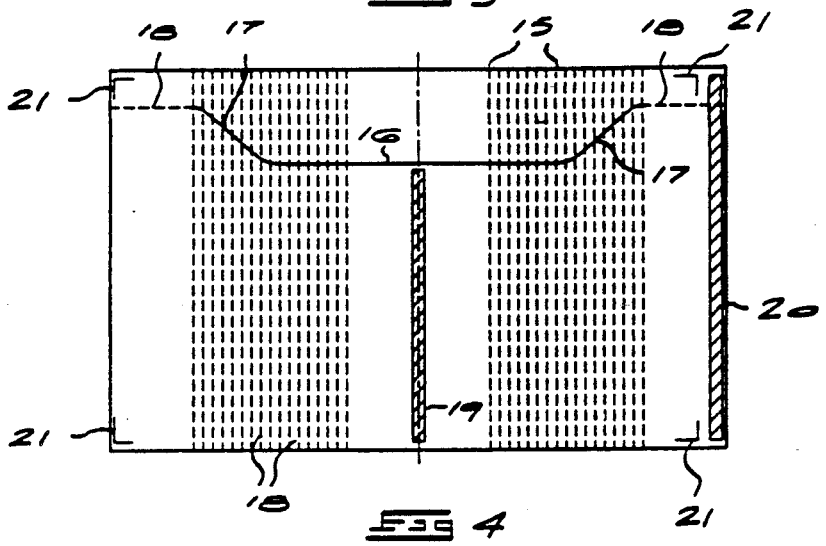
FIG. 3 is a view showing a blank for the outer layer or outer layer or outer shell of the carton.

The carton is made from two shell blanks and two end pieces. The outer shell blank is illustrated in FIG. 3 and the inner shell blank in FIG. 4. The end pieces are the shape of the top 14 in FIG. 1 with chamfered edges.

The blank of FIG. 3 is rectangular in shape and is formed with a series of parallel crease lines 15. It is also formed with a slit having a straight portion 16 and two curved ends 17. The portions 17 lead into crease lines 18 which will, when joined, be the hinge line. In the drawing two glue lines 19 and 20 have been indicated as well as four locating marks 21. The glue line 19 is on what will be the centre of the front panel of the carton.

Figure 4:
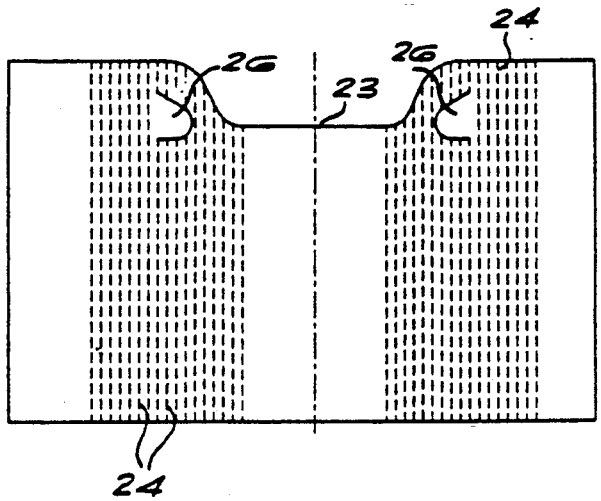
FIG. 4 is a blank showing the inner layer or inner shell of the carton.

The blank of FIG. 4 is rectangular with a cutout 23. It is formed in turn with crease lines 24. Two C-shaped cuts 26 are made in the blank and the areas encompassed by the cuts 26 are free of crease lines.

Figure 5:
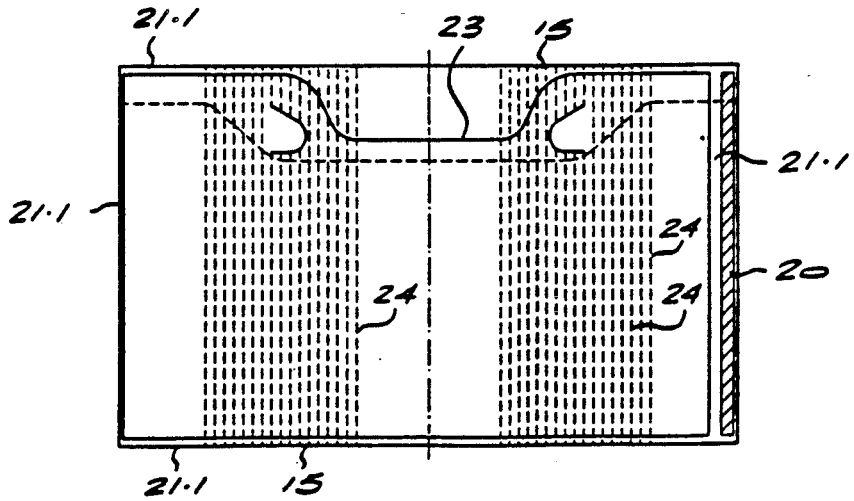
FIG. 5 is a view showing the inner and outer layers superimposed prior to folding.

Prior to folding the blanks of FIGS. 3 and 4 are combined to form the laminate shown in FIG. 5. First glue is applied to the line 19 and then the blank of FIG. 2 is placed on the blank of FIG. 3 along register marks 21 to ensure (referring to FIG. 5) that a rebate or shoulder 21.1 is formed to extend all the way along the external edge of the laminate. The laminate is now ready for folding into tubular form.

Figure 6:
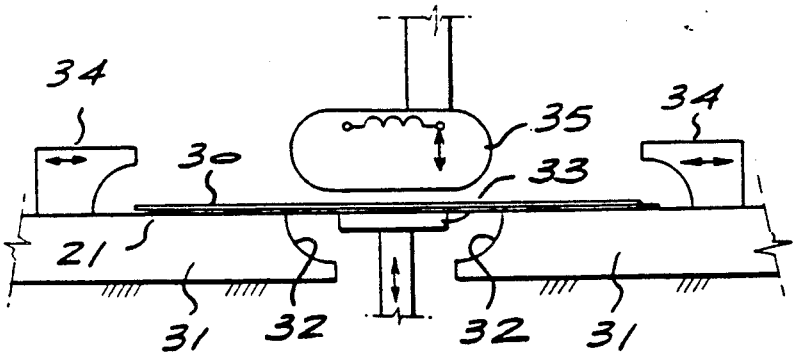
FIGS. 6 to 9 are diagrammatic end views of a carton folding process.

In FIGS. 6 to 9 the process of folding is illustrated. In FIG. 6 the laminate 30 is placed on a bed 31 pierced by a slot with curved sides 32. A plunger 33 can move up and down in the slot. On the sides there are folders 34 which can be caused to move towards one another. The laminate 30 is acted upon by an arbor 35 which if necessary contains a heater element.

Figure 7:
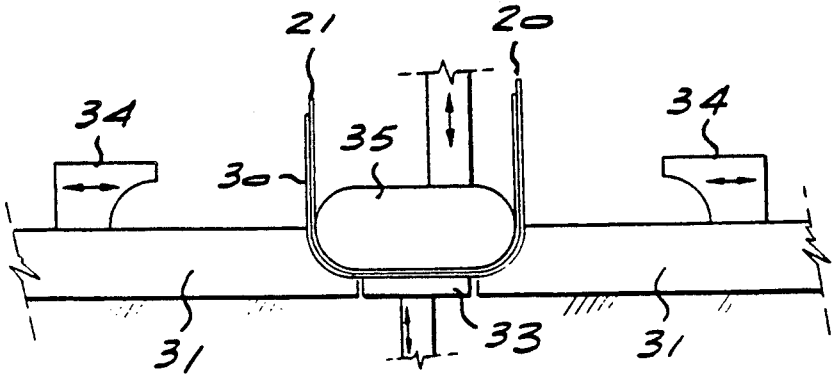
Figure 8:
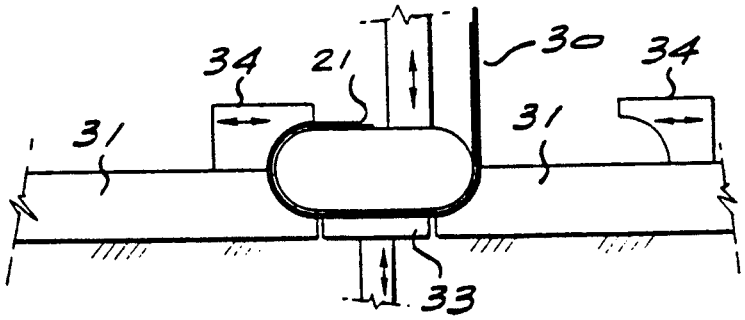
Figure 9:
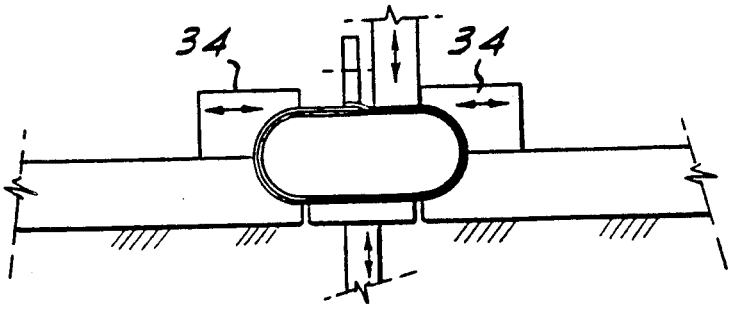

In FIG. 7 the arbor 35 has moved down to contact the laminate 30 and the plunger 33 has retreated to form the base of the slot. In the next Figure the left hand folder 34 has moved in to fold one side of the eventual carton and in FIG. 9 the right hand folder 34 has moved in after glue has been applied, by means not shown, to the glue line 20. The shoulder 21 ensures that the edges of the laminate, after glueing, will be flush. The blank of FIG. 3 forms a closed tube with edges abutting while the line 20 overlaps the rebate 21.1. A roller 36 (FIG. 10) now presses down on the line 20 to cause effective connection.

Next the folders 34 are withdrawn and the arbor 35, with the glued tubular carton shell 30 thereon, is moved to a filling pocket 40 (FIG. 11) where the tubular carton shell 30 is pushed into the filling pocket.

Figure 13:
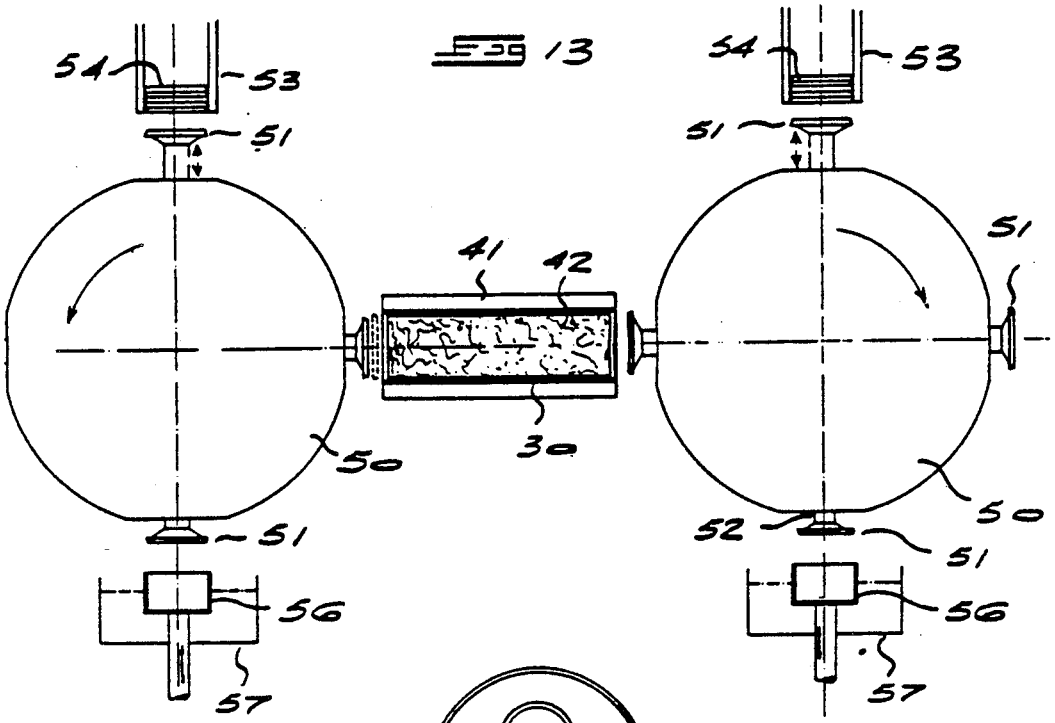
FIG. 13 shows a method of applying end closures to the filled carton.
Figure 14:
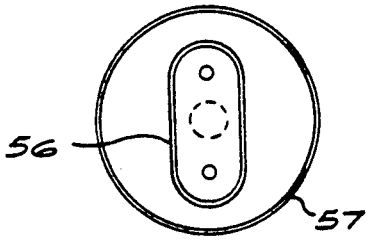
FIG. 14 is a top view of a glue applicator used in the apparatus of FIG. 13.

After the arbor 35 has been removed, a conventional compression turret 41 loaded with a batch of cigarettes 42 is positioned next to the pocket 40 and the batch is pushed into the shell 30 by means of a plunger 44. The loaded pocket 41 (FIG. 13) now moves between a pair of turrets 50 rotating in step in opposite directions. Each turret carries a series of suction cups 51 on stems 52 which can reciprocate radially. On one side of the turrets 50 there are magazines 53 which contain end pieces 54. Suction cups 51 extract the end pieces 54 from the magazines 53 and carry them around first to the gluing station where an applicator applies glue to the end pieces 54.

Each applicator 56 is shaped as a hollow cup with holes in its base to allow excess glue to drain from the applicator cap. The applicator dips into and out of a bowl 57 containing glue. The lip of the applicator 56 is complemental to the outline of the chamfered edges of the end pieces 54 and, upon contact between the applicator 56 and an end piece 54, glue is applied only to the edges of the end piece 54.

As an end piece is held at a gluing station, the applicator 56 moves around once more to the position where the end piece is aligned with the carton shell 30 in the pocket 41. The stems 52 moves radially outwardly to effect positioning of the end pieces and thereafter suction to the suction cups at that position is terminated.

Each cup thus steps around from the magazine 53, where it withdraws an end piece 54, to a position of rest at a gluing station, where glue is applied, and then to the closure station where the end piece is positioned on its shell 30 and suction is discontinued as the stem 52 is pulled back.

The end result is the product shown in FIGS. 1 and 2.

Figure 15:
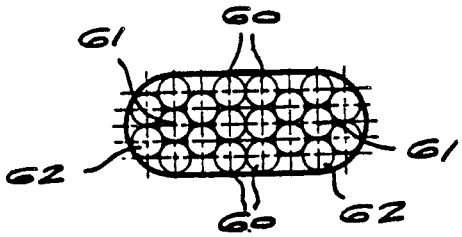
FIGS. 15 and 16 are top views of cigarettes in cartons.

The cartons of the invention can contain any suitable or required number of cigarettes. In the case of the usual pack of twenty cigarettes, the present invention proposes the packing configuration shown in FIG. 15. Here there are six cigarettes 60 at the centre and the remainder grouped as groups of seven in a daisy configuration around a central cigarette 61. Those around the latter have been marked 62.

Figure 16:
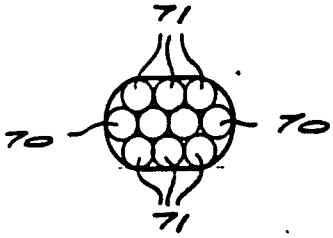

In FIG. 16 a pack of ten cigarettes is illustrated. In this case there are four cigarettes 70 in a central row and three cigarettes 71 in each of two flanking rows.

I claim:

1. A process of manufacturing a carton with parallel flat front and rear surfaces joined by curved sides and a flip-top lid hinged to the carton, the process including the steps of:

cutting inner and outer layer blanks for the carton;

slitting the outer layer blank, along an area defining the front surface of the carton, parallel to the carton ends and along upwardly extending curves, around areas defining the sides of the carton, to a fold line parallel to and raised above the front slit;

forming a cutout in the inner layer blank, in an area defining the front surface of the carton, above the front slit of the outer layer, which cutout curves upwardly short of the side areas, cutting tags out of the sides of the inner layer blank, superimposing the two layers on one another and forming a laminate of the two layers with the outer layer overlapping the inner layer at the carton ends;

shaping the laminate into a tubular shell with parallel flat front and rear surfaces joined by curved sides and adhesively securing the laminate edges at a joint line at overlapping the edges of the shell; and securing top and bottom closures adhesively to the outer layer at the ends of the carton.

* * * * *

UNITED STATES PATENT AND TRADEMARK OFFICE

CERTIFICATE OF CORRECTION

PATENT NO. : 5,092,107

DATED : March 3, 1992

INVENTOR(S) : LAMM

It is certified that error appears in the above-identified patent and that said Letters Patent is hereby corrected as shown below:

On the title page:

Item: "[73] Assignee: Tobacco Research & Development Institute Limited, South Africa"

should be --[73] Assignee: Tobacco Research & Development Institute Limited, Switzerland--

Signed and Sealed this

Tenth Day of May, 1994

*Attest:*

*Attesting Officer*

BRUCE LEHMAN

*Commissioner of Patents and Trademarks*